US012588709B2

(12) United States Patent
Moloney

(10) Patent No.: US 12,588,709 B2
(45) Date of Patent: Mar. 31, 2026

(54) CONSUMABLE ARTICLE CONTAINING AN AERSOLIZABLE MATERIAL

(71) Applicant: British American Tobacco (Investments) Limited, London (GB)

(72) Inventor: Patrick Moloney, London (GB)

(73) Assignee: British American Tobacco (Investments) Limited, London (GB)

( * ) Notice: Subject to any disclaimer, the term of this patent is extended or adjusted under 35 U.S.C. 154(b) by 907 days.

(21) Appl. No.: 17/256,978

(22) PCT Filed: Jul. 2, 2019

(86) PCT No.: PCT/EP2019/067770
§ 371 (c)(1),
(2) Date: Dec. 29, 2020

(87) PCT Pub. No.: WO2020/007879
PCT Pub. Date: Jan. 9, 2020

(65) Prior Publication Data

US 2021/0137168 A1 May 13, 2021

(30) Foreign Application Priority Data

Jul. 4, 2018 (GB) ..... 1810994

(51) Int. Cl.
*A24F 40/465* (2020.01)
*A24F 40/20* (2020.01)

(52) U.S. Cl.
CPC ..... *A24F 40/465* (2020.01); *A24F 40/20* (2020.01)

(58) Field of Classification Search
None
See application file for complete search history.

(56) References Cited

U.S. PATENT DOCUMENTS 5,115,820 A * 5/1992 Hauser ..... A24D 1/22 131/365
7,743,773 B2 * 6/2010 Gaworski ..... A24D 3/043 131/365
9,179,707 B2 * 11/2015 Kaljura ..... A24D 3/041
9,220,301 B2 * 12/2015 Banerjee ..... A24D 3/067
(Continued)

FOREIGN PATENT DOCUMENTS

CN 104095291 A 10/2014
EP 3275321 1/2018
(Continued)

OTHER PUBLICATIONS

International Preliminary Report on Patentability for Application No. PCT/EP2019/067770, mailed on Jan. 14, 2021, 9 pages.
(Continued)

*Primary Examiner* — Oscar C Jimenez
(74) *Attorney, Agent, or Firm* — Merchant & Gould P.C.

(57) ABSTRACT

A consumable article for use with an apparatus arranged to heat aerosolizable material to volatilize at least one component of the aerosolizable material is disclosed. The consumable article has an outer shell and an inner shell within the outer shell. The inner shell contains aerosolizable material. The consumable article also has a thermally insulating layer separating the inner shell from the outer shell.

20 Claims, 3 Drawing Sheets

(56) References Cited

U.S. PATENT DOCUMENTS

| | | | | |
|---|---|---|---|---|
| 11,779,051 | B2 * | 10/2023 | Worm | A24F 40/42 131/328 |
| 2017/0055581 | A1 | 3/2017 | Wilke et al. | |
| 2018/0007960 | A1 * | 1/2018 | Suzuki | A24F 40/48 |
| 2020/0178599 | A1 * | 6/2020 | Worm | A24F 40/42 |
| 2021/0227877 | A1 * | 7/2021 | Brvenik | A24D 1/02 |
| 2022/0087312 | A1 * | 3/2022 | Matsuba | A24D 3/0212 |
| 2022/0322744 | A1 * | 10/2022 | Qi | H05B 3/145 |

FOREIGN PATENT DOCUMENTS

| | | | |
|---|---|---|---|
| JP | 2017510270 | A | 4/2017 |
| JP | 2017140044 | A | 8/2017 |
| JP | 2017225357 | A | 12/2017 |
| JP | 2018511316 | A | 4/2018 |
| JP | 7399894 | B | 12/2023 |
| KR | 20170128492 | A | 11/2017 |
| KR | 20180037019 | A | 4/2018 |
| KR | 20180073626 | | 7/2018 |
| KR | 1020180073626 | | 7/2018 |
| RU | 2606942 | C2 | 1/2017 |
| WO | 2012090294 | A1 | 7/2012 |
| WO | WO2013131764 | | 9/2013 |
| WO | 2017036954 | A1 | 3/2014 |
| WO | 2016159013 | A1 | 10/2016 |
| WO | 2017072147 | A2 | 5/2017 |
| WO | WO2017207586 | | 12/2017 |

OTHER PUBLICATIONS

Office Action for Russian Application No. 2020142579 mailed on Jun. 17, 2021, 5 pages.

International Search Report and Written Opinion for International Application No. PCT/EP2019/067770 date mailed Nov. 4, 2019.

"Notice of Reason for Rejection for Japanese Application No. 2020-571370 mailed on Jun. 27, 2023", 10 pages(5 pages of English Translation and 5 pages of Official Copy).

"Notice of Reasons for Rejection received for Korean Patent Application No. 10-2020-7038059, mailed on Feb. 8, 2023", 15 pages (8 pages of English Translation and 7 pages of Official Copy).

JP Notice of Rejection in JP Appln. No. 2023-206316, dated Dec. 3, 2024, 13 pages (with English Translation).

* cited by examiner

CONSUMABLE ARTICLE CONTAINING AN AERSOLIZABLE MATERIAL

PRIORITY CLAIM

The present application is a National Phase entry of PCT Application No. PCT/EP2019/067770, filed Jul. 2, 2019 which claims priority from GB Patent Application No. 1810994.2 filed Jul. 4, 2018, each of which is hereby fully incorporated herein by reference.

TECHNICAL FIELD

The present invention relates to a consumable article for use with an apparatus arranged to heat aerosolizable material.

BACKGROUND

Articles such as cigarettes, cigars and the like burn tobacco during use to create tobacco smoke. Attempts have been made to provide alternatives to these articles, which burn tobacco, by creating products that release compounds without burning. Examples of such products are so-called heat-not-burn products, also known as tobacco heating products or tobacco heating devices, which release compounds by heating, but not burning, the material. The material may be for example tobacco or other non-tobacco products or a combination, such as a blended mix, which may or may not contain nicotine.

SUMMARY

According to a first aspect of the present invention, there is provided a consumable article for use with an apparatus arranged to heat aerosolizable material to volatilize at least one component of the aerosolizable material, the consumable article comprising:

an outer shell;

an inner shell within the outer shell, the inner shell containing aerosolizable material; and a thermally insulating layer separating the inner shell from the outer shell.

The thermally insulating layer keeps the outer surface of the consumable article at a relatively low temperature with respect to a temperature of the aerosolizable material when in use. This reduces the transfer of heat to the apparatus arranged to heat the consumable article, which may otherwise needlessly heat areas of the apparatus that do not contribute to heating the consumable article, thereby reducing the requirement for insulation or reducing the degree of insulation required. Accordingly, the insulation provided by the thermally insulating layer may provide for more efficient heating of the aerosolizable material, thereby improving the power efficiency of the apparatus for heating the aerosolizable material. Furthermore, the thermally insulating layer enables a user to handle the consumable article following use with reduced risk of discomfort or injury from burns.

In an exemplary embodiment, the apparatus comprises a spacer located between the inner shell and the outer shell, the spacer being arranged to provide a separation between the inner shell and the outer shell.

In an exemplary embodiment, the spacer comprises a material having a thermal conductivity less than 5 W/m·K, less than 2 W/m·K, or less than 1 W/m·K.

In an exemplary embodiment, the spacer comprises one or more of: a cardboard material; a paper material; a wood material; and a plastics material.

In an exemplary embodiment, inner shell and outer shell are cylindrical, the inner shell having a cross-sectional diameter less than a cross-sectional diameter of the outer shell.

In an exemplary embodiment, the spacer comprises a plurality of spacer elements arranged circumferentially about an outer surface of the inner shell.

In an exemplary embodiment, the spacer comprises a corrugated material arranged circumferentially about the outer diameter of the inner shell.

In an exemplary embodiment, inner portions of the corrugated material contact the inner shell and outer portions of the corrugated material contact the outer shell.

In an exemplary embodiment, the consumable article comprises a flow channel comprising a path between the inner and outer shells, the flow channel fluidically connecting a first end of the consumable article and a second end of the consumable article opposite the first end.

In an exemplary embodiment, the consumable article comprises a heater arranged to heat the aerosolizable material.

In an exemplary embodiment, the heater comprises a susceptor material in the inner shell that is heatable by penetration with a varying magnetic field to heat the aerosolizable material.

In an exemplary embodiment, the inner shell comprises a paper material and the susceptor material is bonded to an inner surface of the inner shell.

In an exemplary embodiment, the inner shell is formed of a susceptor material.

In an exemplary embodiment, the susceptor material comprises aluminum.

In an exemplary embodiment, the susceptor material is arranged to be inductively heated when, in use, it is inductively coupled to a corresponding work coil of the apparatus.

In an exemplary embodiment, the heater comprises a resistive heater that is heatable by application of an electric current to heat the aerosolizable material.

In an exemplary embodiment, the heater comprises plural heating elements.

In an exemplary embodiment, the outer shell comprises a paper material.

In an exemplary embodiment, the thermally insulating layer comprises air and/or a solid-based thermally insulating material.

According to a second aspect of the present invention, there is provided an apparatus arranged to heat aerosolizable material to volatilize at least one component of said aerosolizable material, the apparatus comprising a housing arranged to receive a consumable article according to the first aspect of the present invention.

In an exemplary embodiment, the apparatus comprises a consumable article according to the first aspect of the present invention.

In an exemplary embodiment, the apparatus comprises a resistive heater arranged to be inserted into the aerosolizable contained within the inner shell.

According to a third aspect of the present invention, there is provided an apparatus arranged to heat aerosolizable material to volatilize at least one component of the aerosolizable material, the consumable article comprising:

an outer shell;

an inner shell within the outer shell; and a heater element arranged within the inner shell for heating the aerosolizable material, wherein the inner shell and outer shell are separated by a thermally insulating layer.

BRIEF DESCRIPTION OF THE DRAWINGS

Embodiments of the invention will now be described, by way of example only, with reference to the accompanying drawings, in which.

DETAILED DESCRIPTION

Figure 1:
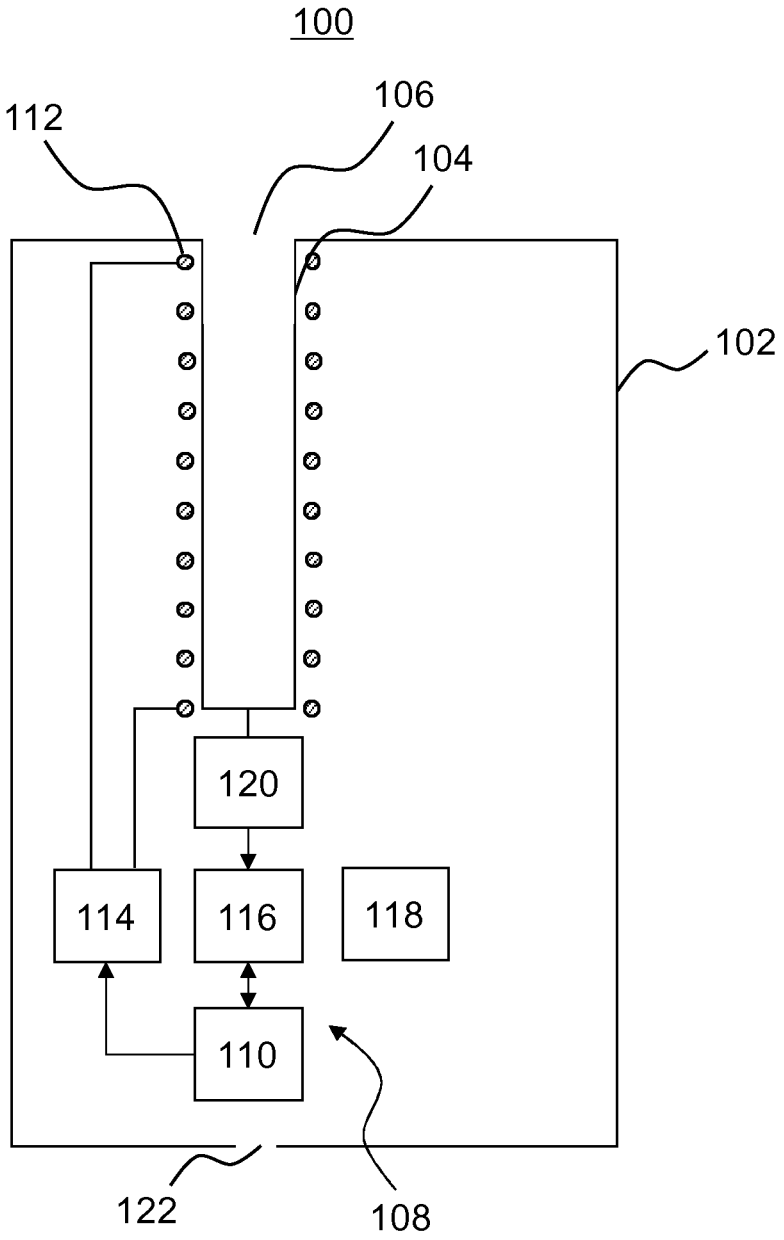
FIG. 1 shows a schematic cross-sectional view of an example of an apparatus for heating an aerosolizable material to volatilize at least one component of the aerosolizable material.

Apparatus is known that heats aerosolizable material to volatilize at least one component of the aerosolizable material, typically to form an aerosol which can be inhaled, without burning or combusting the aerosolizable material. Such apparatus is sometimes described as a "heat-not-burn" apparatus or a "tobacco heating product" or "tobacco heating device" or similar. Similarly, there are also so-called e-cigarette devices, which typically vaporize an aerosolizable material in the form of a liquid, which may or may not contain nicotine. In general, the aerosolizable material may be in the form of or provided as part of a rod, cartridge or cassette or the like which can be inserted into the apparatus. A heating material for heating and volatilizing the aerosolizable material may be provided as a "permanent" part of the apparatus or may be provided as part of the consumable article which is discarded and replaced after use. A "consumable article" in this context is a device or article or other component that includes or contains in use the aerosolizable material, which in use is heated to volatilize the aerosolizable material.

As used herein, the term "aerosolizable material" includes materials that provide volatilized components upon heating, typically in the form of vapor or an aerosol. "Aerosolizable material" may be a non-tobacco-containing material or a tobacco-containing material. "Aerosolizable material" may, for example, include one or more of tobacco per se, tobacco derivatives, expanded tobacco, reconstituted tobacco, tobacco extract, homogenized tobacco or tobacco substitutes. The aerosolizable material can be in the form of ground tobacco, cut rag tobacco, extruded tobacco, reconstituted tobacco, reconstituted aerosolizable material, liquid, gel, gelled sheet, powder, or agglomerates, or the like. "Aerosolizable material" also may include other, non-tobacco products, which, depending on the product, may or may not contain nicotine. "Aerosolizable material" may comprise one or more humectants, such as glycerol or propylene glycol.

As used herein, the term "heating material" or "heater material" refers to material that is heatable by penetration with a varying magnetic field.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. An object that is capable of being inductively heated is known as a susceptor.

Referring to FIG. 1 there is shown a schematic cross-sectional view of an example of apparatus according to an embodiment of the invention. The apparatus 100 is for heating aerosolizable material to volatilize at least one component of the aerosolizable material.

The apparatus 100 comprises an apparatus housing 102, referred to hereinafter as a body 102. The body 102 comprises a heating zone 104 for receiving at least a portion of a consumable article comprising aerosolizable material that is to be heated. The apparatus 100 has an outlet 106 for material that is heatable to permit volatilized components of the aerosolizable material to pass from the heating zone 104 towards an exterior of the apparatus 100 when the article is heated in the heating zone 104 in use. The apparatus 100 also comprises a magnetic field generator 108 for generating the varying magnetic field in use.

The apparatus 100 may define an air inlet that fluidly connects the heating zone 104 with the exterior of the apparatus 100. A user may be able to inhale the volatilized component(s) of the aerosolizable material by drawing the volatilized component(s) from the consumable article. As the volatilized component(s) are removed from the consumable article, air may be drawn into the heating zone 104 via the air inlet of the apparatus 100.

In this embodiment, the heating zone 104 comprises a recess or cavity for receiving at least a portion of the consumable article. In other embodiments, the heating zone 104 may be other than a recess, such as a shelf, a surface, or a projection, and may require mechanical mating with the consumable article in order to co-operate with, or receive, the consumable article. In this embodiment, the heating zone 104 is elongate, and is sized and shaped to accommodate a portion of the consumable article such that a further portion of the consumable article protrudes from the body 102. In other embodiments, the heating zone 104 may be dimensioned to receive the whole of the consumable article.

The magnetic field generator 108 comprises an electrical power source 110, a coil 112, a device 114 for passing a varying electrical current, such as an alternating current, through the coil 112, a controller 116, and a user interface 118 for user-operation of the controller 116.

The electrical power source 110 of this embodiment is a rechargeable battery. In other embodiments, the electrical power source 110 may be other than a rechargeable battery, such as a non-rechargeable battery, a capacitor, a battery-capacitor hybrid, or a connection to a mains electricity supply.

The coil 112 may take any suitable form. The coil 112 is sometimes referred to as a work coil. In this embodiment, the coil 112 is a helical coil of electrically-conductive material, such as copper. In some embodiments, the magnetic field generator 108 may comprise a magnetically permeable core around which the coil 112 is wound. Such a magnetically permeable core concentrates the magnetic flux produced by the coil 112 in use and makes a more powerful magnetic field. The magnetically permeable core may be made of iron, for example. In some embodiments, the magnetically permeable core may extend only partially along the length of the coil 112, so as to concentrate the magnetic flux only in certain regions. In some embodiments, the coil may be a flat coil. That is, the coil may be a two-dimensional spiral. The coil 112 extends along a longitudinal axis that is substantially aligned with a longitudinal axis of the heating zone 104.

The device 114 for passing a varying current through the coil 112 is electrically connected between the electrical power source 110 and the coil 112. The controller 116 also is electrically connected to the electrical power source 110, and is communicatively connected to the device 114 to control the device 114. More specifically, the controller 116 is for controlling the device 114, so as to control the supply of electrical power from the electrical power source 110 to the coil 112. The controller 116 may, for example, comprise an integrated circuit (IC), such as an IC on a printed circuit board (PCB). The apparatus 100 may have a single electrical or electronic component comprising the device 114 and the controller 116.

In the described example, the controller 116 is operated by user-operation of the user interface 118. The user interface 118 is located at the exterior of the body 102. The user interface 118 may, for example, comprise a push-button, a toggle switch, a dial, a touchscreen, or the like. In other embodiments, the user interface 118 may be remote and connected to the rest of the apparatus wirelessly, such as via Bluetooth.

Operation of the user interface 118 by a user causes the controller 116 to cause the device 114 to cause an alternating electrical current to pass through the coil 112, so as to cause the coil 112 to generate an alternating magnetic field. The coil 112 and the heating zone 104 of the apparatus 100 are suitably relatively positioned so that the varying magnetic field produced by the coil 112 penetrates the heating zone 104. As described above, when a heating material is an electrically-conductive material, this may cause the generation of one or more eddy currents in the heating material. The flow of eddy currents in the heating material against the electrical resistance of the heating material causes the heating material to be heated by Joule heating.

As described below, in use, a consumable article is inserted into the heating zone 104. In this embodiment the consumable article comprises a heating element made of a heating material which is susceptible to heating by the application of a varying magnetic field. Accordingly, when a consumable is present in the heating zone 104, and the device 114 applies a varying magnetic field to the coil 112, the heating element is heated to heat the aerosolizable material to volatilize components of the aerosolizable material.

In other embodiments, the heating element may instead be part of the apparatus 100. For example, the heating zone of apparatus 100 may comprise a heating element arranged to pierce the consumable article and provide internal heating of the aerosolizable material. For example, the apparatus 100 may comprise a spike over which the consumable article is placed when inserted into the apparatus 100. Such a heating element may itself be inductively heated by a coil surrounding the heating zone of the apparatus, or may be a resistive heater that generates heat by passing electrical current through a resistive electrical winding. Alternatively, the apparatus 100 may comprise an infrared heater, which heats the aerosolizable material by irradiating it with infrared radiation.

An impedance of the coil 112 of the magnetic field generator 108 is equal, or substantially equal, to an impedance of the heating element of the consumable article. If the impedance of the heating element were instead lower than the impedance of the coil 112, then the voltage generated across the heating element in use may be lower than the voltage that may be generated across the heating element when the impedances are matched. Alternatively, if the impedance of the heating element were instead higher than the impedance of the coil 112, then the electrical current generated in the heating element in use may be lower than the current that may be generated in the heating element when the impedances are matched. Matching the impedances may help to balance the voltage and current to maximize the heating power generated at the heating element in use. In some embodiments, the impedance of the device 114 may be equal, or substantially equal, to a combined impedance of the coil 112 and the heating element of the consumable article.

The apparatus 100 comprises a temperature sensor 120 for sensing a temperature of a portion of a consumable article inserted in the heating zone 104, such as the portion of the consumable article comprising aerosolizable material. In some embodiments, the temperature sensor 120 may be arranged to determine or infer a temperature of a portion of the consumable article based on a wirelessly detected property of a heating element within the consumable article (e.g. based on an apparent change in impedance of a susceptor material). The temperature sensor 120 is communicatively connected to the controller 116, so that the controller 116 is able to monitor the temperature of the portion of a consumable article. On the basis of one or more signals received from the temperature sensor 120, the controller 116 may cause the device 114 to adjust a characteristic of the varying or alternating electrical current passed through the coil 112 as necessary, in order to ensure that the temperature of the portion of a consumable article remains within a predetermined temperature range. The characteristic may be, for example, amplitude or frequency or duty cycle. Within the predetermined temperature range, in use the aerosolizable material within a consumable article located in the heating zone 104 is heated sufficiently to volatilize at least one component of the aerosolizable material without combusting the aerosolizable material. Accordingly, the controller 116, and the apparatus 100 as a whole, is arranged to heat the aerosolizable material to volatilize the at least one component of the aerosolizable material without combusting the aerosolizable material. In some embodiments, the temperature range of the aerosolizable material in use may be between 100° C. and 300° C., such as between about 170° C. and about 250° C. In other embodiments, the temperature range may be other than this range. In some embodiments, the upper limit of the temperature range could be greater than 300° C. In some embodiments, the temperature sensor 120 may be omitted. In some embodiments, the heating material may have a Curie point temperature selected on the basis of the maximum temperature to which it is desired to heat the heating material, so that further heating above that temperature by induction heating the heating material is hindered or prevented.

In some embodiments, the temperature sensor 120 may be arranged to directly measure a temperature within the apparatus 100, such as a temperature of the heating zone 104, and the controller 116 may be arranged to infer from measured temperature a temperature of the portion of a consumable article inserted in the heating zone 104. In such embodiments, the temperature of the heating zone may be in the range 60° C. to 120° C., for example.

In order to permit air to enter the apparatus 100, and be drawn through a consumable article inserted into the apparatus 100, the apparatus 100 may comprise one or more air inlets 122 located at a surface of the body 102, that are fluidically connected to a distal end of the heating zone 104.

Figure 2:
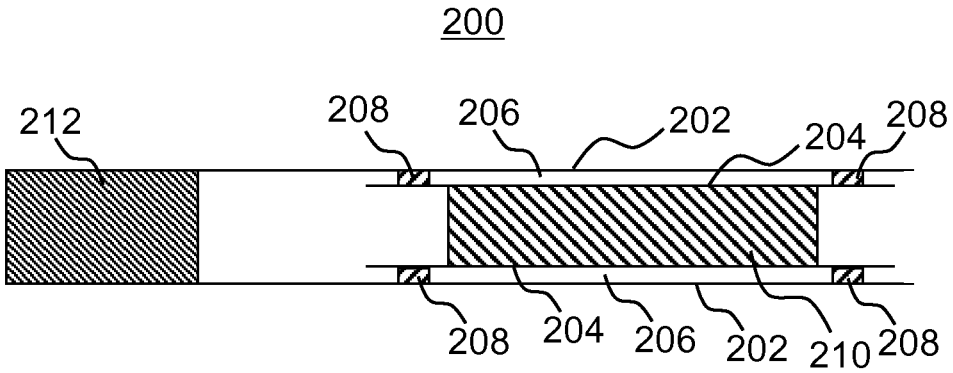
FIG. 2 shows a schematic cross-sectional view of a consumable article.

Referring to FIG. 2 there is shown an apparatus which is a consumable article 200 for use with an apparatus arranged to heat aerosolizable material to volatilize at least one component of the aerosolizable material, such as the apparatus 100 described above with reference to FIG. 1, according to an embodiment of the invention. The consumable article 200 comprises an outer shell 202 and an inner shell 204. Separating the inner shell 204 from the outer shell 202 is a thermally insulating layer 206.

The thermally insulating layer 206 keeps aerosol generating material away from the outside surface of the consumable article 200. Accordingly, the thermally insulating layer 206 keeps the outer surface of the consumable article 200 at a relatively low temperature with respect to a temperature of aerosolizable material when in use. This reduces the transfer of heat to the apparatus 100 arranged to heat the consumable article 200, which may otherwise needlessly heat areas of the apparatus 100 that do not contribute to heating the consumable article 200, thereby reducing the requirement for insulation or reducing the degree of insulation required within the apparatus 100. Accordingly, the insulation provided by the thermally insulating layer 206 may provide for more efficient heating of the aerosolizable material, since less heat is lost through conduction. Accordingly, this may improve the power efficiency of the apparatus 100 for heating the aerosolizable material. Furthermore, the thermally insulating layer 206 enables a user to handle the consumable article 200 following use with reduced risk of discomfort or injury from burns.

In the example shown in FIG. 2, the consumable article comprises one or more spacers 208 located between the inner shell 204 and the outer shell 202. The spacers 208 maintain an air gap between the inner shell 204 and the outer shell 202, which provides the thermally insulating layer 206. Air has a low thermal conductivity in the range 0.26 to 0.04 W/m·K (depending on temperature) and accordingly provides good thermal insulation between the inner shell 204 and the outer shell 202.

The spacers 208 may be made from one or more of: cardboard material, a paper material, a wood material and a plastics material, for example. Cardboard and paper materials typically have a thermal conductivity of ~0.05 W/m·K, wood materials typically have a thermal conductivity in the range 0.04 to 0.17 W/m·K, and plastics materials typically have a thermal conductivity in the range 0.05 to 0.3 W/m·K. Accordingly, spacers 208 made from these materials also provide good insulation between the inner shell 204 and the outer shell 202.

In the example shown in FIG. 2, the inner shell 204 and outer shell 202 are cylindrical and the spacers 208 are annular spacers. Accordingly, the inner shell 204 and outer shell 202 are coaxial. The spacers 208 form an airtight or near-airtight seal between the inner shell 204 and the outer shell 202. Accordingly, in use, air containing volatilized components from the aerosolizable material may be drawn through the inner shell 204 whereas air in the space between the inner shell 204 and the outer shell 202 remains static. Although two spacers are shown in FIG. 2, in other embodiments, more or less spacers may be used to provide a separation between the inner shell 204 and the outer shell 202.

Located within the inner shell 204 may be provided a substrate 210 comprising aerosolizable material. For example, the substrate 210 may comprise, tobacco, tobacco derivatives, expanded tobacco, reconstituted tobacco, tobacco extract, homogenized tobacco or tobacco substitutes, which may be located within the inner shell 204, as described above. Alternatively, the substrate 210 may comprise non-tobacco products, which, depending on the product, may or may not contain nicotine.

In the embodiment shown in FIG. 2, the consumable article 200 comprises a filter portion 212. For example, the filter portion 212 may comprise filtering material such as cellulose acetate fiber. The filter portion 212 may, in use, act as a mouthpiece for the consumable article 200, through which air containing volatilized components from the aerosolizable material may be drawn. At the opposite end of the consumable article 200 from the filter portion, at what is sometimes referred to as a distal end, there is an opening into which air can be drawn to then be drawn through the consumable article 200.

In other embodiments, the filter 210 may be omitted. For example, in some embodiments, the consumable article 200 may be contained entirely within an apparatus and the apparatus may be provided with a mouthpiece via which a user may draw air containing volatilized components from the aerosolizable material.

In some embodiments, the consumable article comprises an integral heating element to heat aerosolizable material in the substrate 210 to volatilized at least one component of the aerosolizable material.

Figure 3:
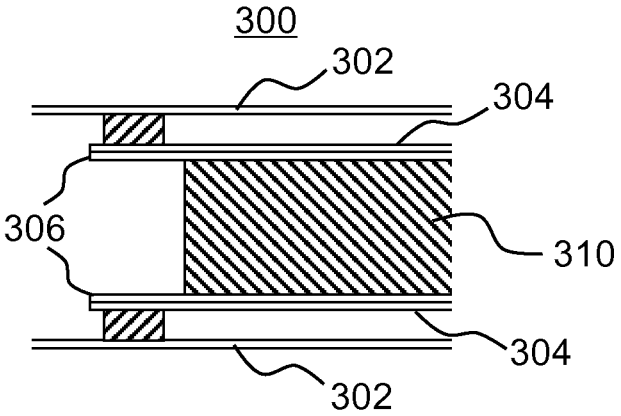
FIG. 3 shows a schematic cross-sectional view of an enlarged portion of a consumable article.

Referring to FIG. 3 there is shown an enlarged view of a portion of a consumable article 300 according to an embodiment of the invention. In the embodiment shown in FIG. 3, the consumable article comprises an outer shell 302 and an inner shell 304, similar to the consumable article 200 shown in FIG. 2. Furthermore, similar to the consumable article 200 shown in FIG. 2, the inner shell 304 is arranged to contain a substrate 310 comprising aerosolizable material.

In the embodiment shown in FIG. 3, bonded to the inner shell 304 is a heating element 306. The heating element 306 comprises a heating material that is heatable by penetration with a varying magnetic field that and, as described above, accordingly acts as a susceptor. For example, the heating element 306 may be formed of a metal material such as aluminum. In other examples, the heating element 306 may be formed of or may be made of a ceramics material such as alumina and aluminum nitride or silicon nitride, which may be bonded, laminated and/or sintered onto a surface of the inner shell 304, such as an inner surface of the inner shell 304 as shown in FIG. 3. The inner shell 304 itself may be formed of a cardboard material or a paper material, for example.

Figure 4:
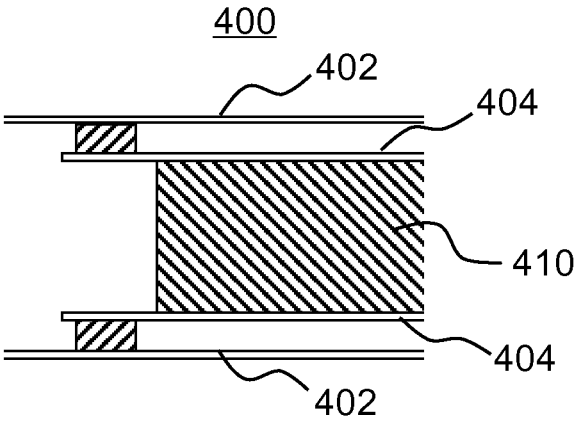
FIG. 4 shows a schematic cross-sectional view of an enlarged portion of a consumable article.

Referring to FIG. 4, there is shown an enlarged view of a portion of another consumable article 400 according to an embodiment of the invention. Similar to the embodiments shown in FIGS. 2 and 3, the consumable article 400 comprises an outer shell 402 and an inner shell 404, and the inner shell 404 is arranged to contain a substrate 410 comprising aerosolizable material. However, in the consumable article 400 shown in FIG. 4, the inner shell 304 itself comprises a heating material that is heatable by penetration with a varying magnetic field that and, as described above, accordingly acts as a susceptor. For example, the heating material may be formed of a metal material such as aluminum, or a ceramic material such as alumina and aluminum nitride or silicon nitride. Alternatively, the inner shell 404 may be formed of a substrate material, such as a paper material or a cardboard material, impregnated with a metal material such as aluminum, or a ceramic material such as alumina and aluminum nitride or silicon nitride.

Although the consumable articles 300, 400 described with reference to FIGS. 3 and 4 are described as having a single heating element, in some embodiments, the consumable article may comprise plural heating elements. For example, the consumable article may comprise different heating elements to heat different zones of the substrate.

In the embodiments described above with reference to FIGS. 2 to 4, the inner shell of the consumable article is separated from the outer shell by spacers which form an air gap in which, during use of the consumable article, contains static air which provides a thermally insulating layer. However, in some embodiments, rather than provide a relatively airtight seal between the inner shell and the outer shell, the spacers may provide a fluidic path through which air may flow when a user draws air through the consumable article.

Figure 5:
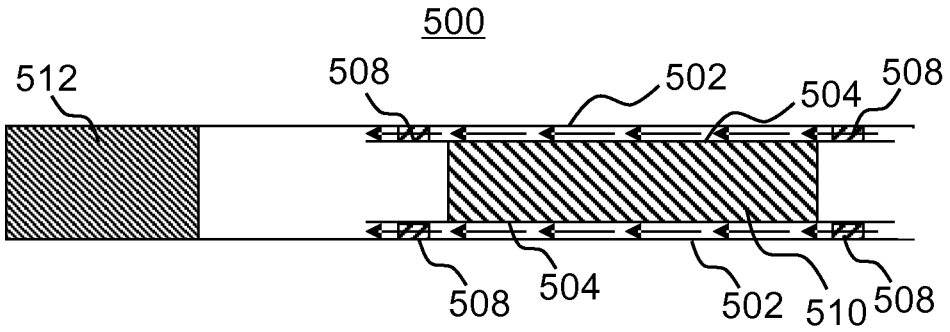
FIG. 5 shows a schematic cross-sectional view of a consumable article.

Referring to FIG. 5, there is shown a consumable article 500 in which, in use, a dynamic air flow provides a thermal insulation. Similar to the consumable articles described above with reference to FIGS. 2 to 4, the consumable article 500 shown in FIG. 5 comprises an outer shell 502 and an inner shell 504, separated by a thermally insulating layer 506. The inner shell 504 also is arranged to contain a substrate 510 comprising aerosolizable material.

The consumable article 500 shown in FIG. 5 may also comprise a filter and/or one or more heating elements, similar to those described with reference to the consumable articles described above with reference to FIGS. 2 to 4. Furthermore, similar to the consumable article 200 described above with reference to FIG. 2, at the opposite end of the consumable article 500 to the filter, there may be an opening into which air can be drawn to then be drawn through the consumable article 500.

The consumable article 500 shown in FIG. 5 also contains one or more spacers 508 located between the inner shell 504 and the outer shell 502, which maintain an air gap between the inner shell 504 and the outer shell 502 to provide the thermally insulating layer 506. However, the spacer 508 shown in FIG. 5 does not form an airtight seal between the inner shell 504 and the outer shell 502 but instead permits a flow of air between the inner shell 504 and the outer shell 502 when a user draws air through the consumable article 500. For example, as shown by the arrows in FIG. 5, the space between the inner shell 504 and the outer shell 502 may define a flow channel along a longitudinal direction of the consumable article 500. The flow channel may thus define a path, in addition to a flow path through the substrate 510, between the inner shell 504 and the outer shell 502 that fluidically connecting one end of the consumable article with the other, opposite, second end of the consumable article 500.

In one embodiment, the spacers 508 may comprise an air-permeable material which allow a flow of air through the material along a longitudinal path similar to that described above with reference to FIG. 5.

Figure 6:
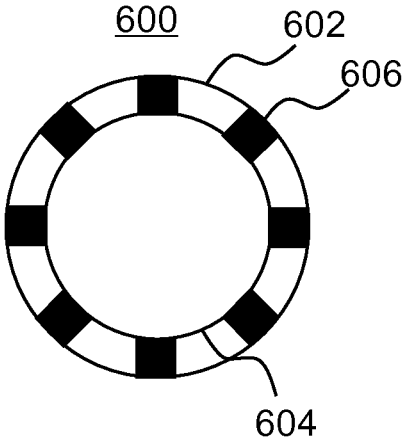
FIG. 6 shows a schematic cross-sectional view of a consumable article.

FIG. 6 shows a cross-sectional view of another embodiment of a consumable article 600 in which the spacer permits a flow of air between an inner shell 604 and an outer shell 602 when a user draws air through the consumable article 600. In the embodiment shown in FIG. 6, the spacer comprises a plurality of spacer elements 606 arranged circumferentially about an outer surface of the inner shell. Between the spacer elements 606 are gaps through which air can flow along a longitudinal path similar to that described above with reference to FIG. 5.

Figure 7:
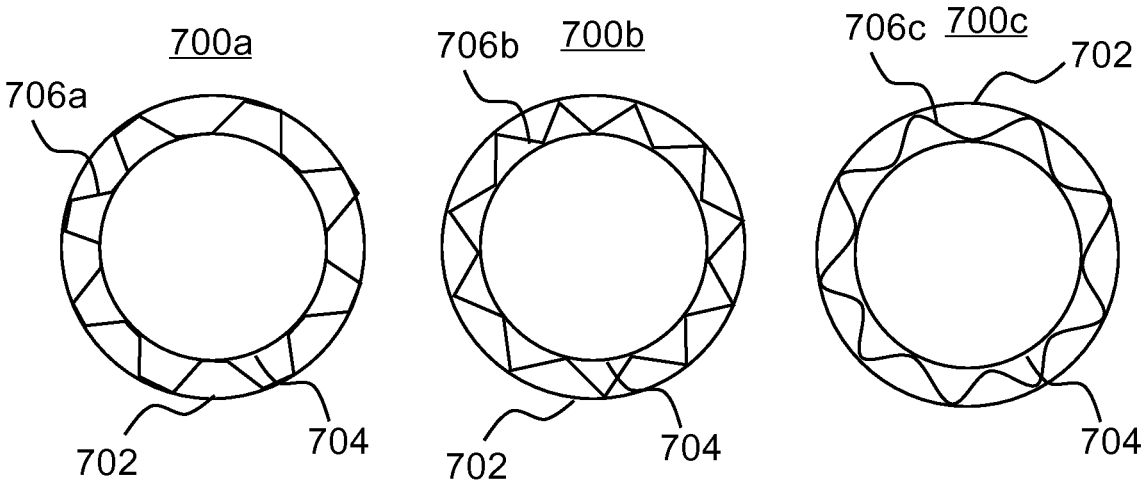
FIG. 7 shows a schematic cross-sectional view of a consumable article.

FIG. 7 shows cross-sectional views of other embodiments of consumable articles 700*a*, 700*b*, 700*c* in which the spacer permits a flow of air between an inner shell 604 and an outer shell 602 when a user draws air through the consumable article 600. In these embodiments, the spacer 706*a*, 706*b*, 706*c* comprises corrugated material arranged circumferentially about the outer diameter of the inner shell. For example, the spacer 706*a*, 706*b*, 706*c* may comprise a corrugated paper material, cardboard material or plastics material. As shown in each of the embodiments shown in FIG. 7, inner portions of the corrugated material contact the inner shell and outer portions of the corrugated material contact the outer shell. This provides gaps through which air can flow along a longitudinal path similar to that described above with reference to FIG. 5.

Although in the embodiments described above with reference to FIGS. 1 to 7, heating of the aerosolizable material to volatilize at least one component of the aerosolizable material is provided by an inductive heating arrangement provided within the consumable article, in some embodiments heating may be provided by other heating arrangements instead of or in addition to an inductive heating arrangement within the consumable article. For example, the consumable article may be provided with a resistive heating arrangement instead of, or in addition to an inductive heating arrangement. In other examples, the apparatus arranged to heat aerosolizable material may itself comprise a heating arrangement to heat the aerosolizable material by inductive heating, resistive heating or radiative heating (i.e. by infrared radiation) or some combination thereof.

Furthermore, although in the embodiments described above with reference to FIGS. 2 to 7, the thermally insulating layer comprises one or more air gaps, in some embodiments, the thermal insulation may be provided by, or improved by the addition of a solid-based thermally insulating material in one or more portions of the space between the inner shell and the outer shell.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A consumable article for use with an apparatus arranged to heat aerosolizable material, the consumable article comprising:

an outer shell;

an inner shell within the outer shell, the inner shell containing the aerosolizable material;

a thermally insulating layer separating the inner shell from the outer shell; and a heater arranged to heat the aerosolizable material, wherein the heater forms a layer that is:

positioned between the inner shell and the aerosolizable material, embedded within the inner shell, or formed by the inner shell, and wherein the heater comprises a susceptor material that is heatable by penetration with a varying magnetic field to heat the aerosolizable material.

2. The consumable article according to claim 1, further comprising a spacer located between the inner shell and the outer shell, the spacer being arranged to provide a separation between the inner shell and the outer shell.

3. The consumable article according to claim 2, wherein the spacer comprises a material having a thermal conductivity less than 5 W/m·K.

4. The consumable article according to claim 2, wherein the spacer comprises one or more materials chosen from a cardboard material, a paper material, a wood material, and a plastics material.

5. The consumable article according to claim 2, wherein the spacer comprises a plurality of spacer elements arranged circumferentially about an outer surface of the inner shell.

6. The consumable article according to claim 2, wherein the spacer comprises a corrugated material arranged circumferentially about an outer diameter of the inner shell.

7. The consumable article according to claim 6, wherein one or more inner portions of the corrugated material contact the inner shell and one or more outer portions of the corrugated material contact the outer shell.

8. The consumable article according to claim 1, wherein the inner shell and outer shell are cylindrical, the inner shell having a cross-sectional diameter less than a cross-sectional diameter of the outer shell.

9. The consumable article according to claim 1, further comprising a flow channel comprising a path between the inner and outer shells, the flow channel fluidically connecting a first end of the consumable article and a second end of the consumable article opposite the first end.

10. The consumable article according to claim 1, wherein the inner shell comprises a paper material and the susceptor material is bonded to an inner surface of the inner shell.

11. The consumable article according to claim 1, wherein the susceptor material comprises aluminum.

12. The consumable article according to claim 1, wherein the heater comprises a plurality of heating elements.

13. The consumable article according to claim 1, wherein the outer shell comprises a paper material.

14. The consumable article according to claim 1, wherein the thermally insulating layer comprises air and/or a solid-based thermally insulating material.

15. An apparatus arranged to heat aerosolizable material to volatilize at least one component of the aerosolizable material, the apparatus comprising a housing and the consumable article according to claim 1, the housing arranged to receive the consumable article.

16. The apparatus according to claim 15, further comprising a resistive heater arranged to be inserted into the aerosolizable material contained within the inner shell.

17. The consumable article according to claim 1, wherein the outer shell extends along a substantial length of the consumable article.

18. The consumable article according to claim 1, further comprising a plurality of spacers, wherein at least a portion of the thermally insulating layer is located longitudinally between the plurality of spacers.

19. The consumable article according to claim 1, wherein the heater is configured to be heated without direct electrical contact by the apparatus.

20. An apparatus arranged to heat aerosolizable material to volatilize at least one component of the aerosolizable material, the apparatus comprising a consumable article, the consumable article comprising:

an outer shell;

an inner shell within the outer shell, the inner shell containing the aerosolizable material; and a heater element arranged for heating the aerosolizable material, wherein the inner shell and outer shell are separated by a thermally insulating layer, wherein the heater element forms a layer that is:

positioned between the inner shell and the aerosolizable material, embedded within the inner shell, or formed by the inner shell, wherein the heater element comprises a susceptor material that is heatable by penetration with a varying magnetic field to heat the aerosolizable material.

* * * * *